United States Patent [19]

Cvetko et al.

[11] 4,065,648

[45] Dec. 27, 1977

[54] MICROPHONE SCREEN

[75] Inventors: Henry J. Cvetko; Donald W. Peterson, both of Conneaut, Ohio

[73] Assignee: The Astatic Corporation, Conneaut, Ohio

[21] Appl. No.: 731,293

[22] Filed: Oct. 12, 1976

[51] Int. Cl.[2] ..... H04R 1/00

[52] U.S. Cl. ..... 179/178

[58] Field of Search ..... 179/121 D, 178, 184, 179/179

[56] References Cited

U.S. PATENT DOCUMENTS

| | | | |
|---|---|---|---|
| 2,200,097 | 5/1940 | Phelps | 179/178 |
| 2,623,957 | 12/1952 | Cragg et al. | 179/178 |
| 3,652,810 | 3/1972 | Weingartner | 179/184 |
| 3,766,333 | 10/1973 | Watson | 179/115.5 R |
| 3,862,377 | 1/1975 | Burroughs | 179/184 X |

*Primary Examiner*—William C. Cooper

*Attorney, Agent, or Firm*—Michael Williams

[57] ABSTRACT

An improved microphone structure having a ball screen enclosing the transducer. The microphone body or handle has an annular shoulder at its upper end to provide an upstanding externally threaded projection. The lower part of the ball screen has an opening to receive the upstanding handle projection, the peripheral portion of the screen at the opening being turned inwardly and adapted to be secured to an internally threaded base ring. The base ring is threaded on the handle projection to secure the ball screen in place.

10 Claims, 5 Drawing Figures

MICROPHONE SCREEN

BACKGROUND AND SUMMARY

The present invention relates to new and useful improvements in microphone construction. The following U.S. patents afford an understanding of the prior art presently known to applicants:

| | | |
|---|---|---|
| 2 346 394 | Rettinger | Apr 11, 1944 |
| 3 515 821 | DeNardi | Jun 22, 1970 |
| 3 652 810 | Weingartner | Mar 28, 1972 |
| 3 651 286 | Gorike | Mar 21, 1972 |
| 3 766 333 | Watson | Oct 16, 1973 |

Attention is also directed to the construction shown in FIG. 1 of the drawing accompanying this application, wherein there is shown a prior construction manufactured by the assignee of the present invention.

The invention is directed to a microphone having a removable ball head, and relates particularly to a new and novel way of mounting the ball screen assembly to the microphone body or handle.

With reference to the prior art shown in FIG. 1 of the drawing, the weakest junction in the ball screen assembly has usually been at the place where the bottom screen is soldered in a slot in the base ring. With the improved assembly herein disclosed, the bottom screen has an opening to receive an externally threaded projection disposed at the top of the microphone handle. The peripheral portion of the screen at the opening is turned inwardly and is bonded to a internally threaded base ring. The base ring is threaded on the projection at the top of the microphone handle, and threading may be continued until the aforementioned peripheral portion of the lower ball screen is clamped between the base ring and an annular shoulder on the microphone handle. This considerably increases the strength of the base ring and ball screen with the microphone handle and, at the same time improves the appearance of the microphone in that the base ring is hidden.

DESCRIPTION OF THE DRAWING

In the drawing accompanying this specification and forming a part of this application, there is shown, for purpose of illustration, an embodiment which our invention may assume and in this drawing.

DESCRIPTION OF THE PREFERRED EMBODIMENT

Figure 1:
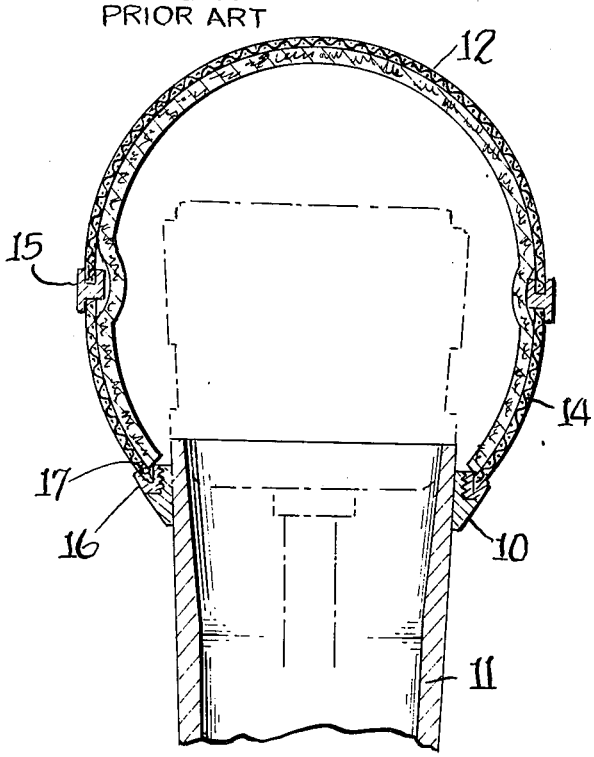
FIG. 1. PRIOR ART
FIG. 1 is a fragmentary sectional view of a ball head assembly of a microphone, showing a prior art construction.
Figure 4:
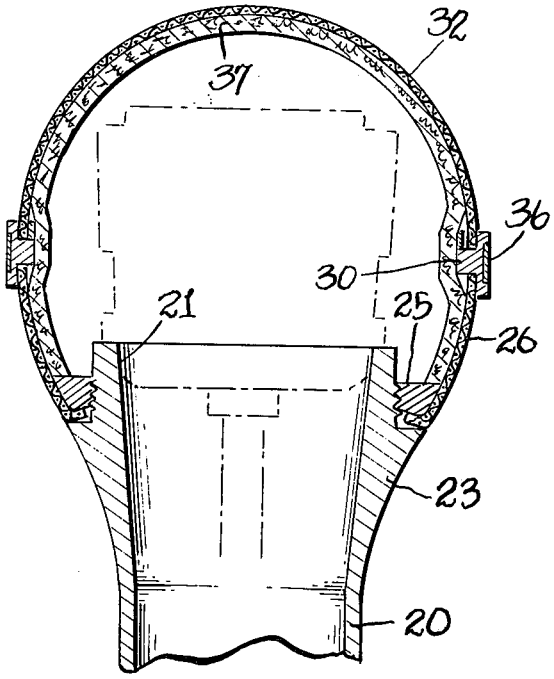
FIG. 4 is a fragmentary sectional view corresponding to the line 4—4 of FIG. 2, drawn to an enlarged scale.
Figure 2:
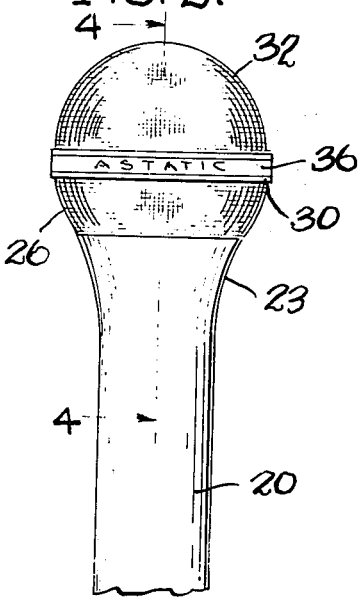
FIG. 2 is a fragmentary side elevational view of a microphone, drawn to a reduced scale, and showing a microphone in accordance with our invention.
Figure 3:
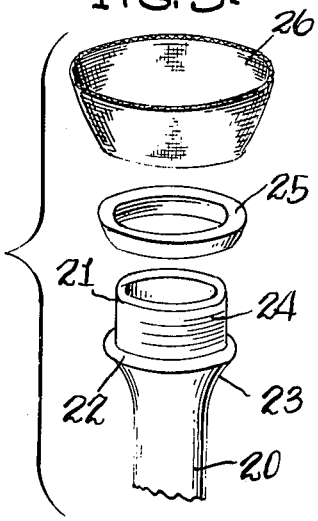
FIG. 3 is a separated perspective view, showing component parts of our improved ball head assembly.
Figure 5:
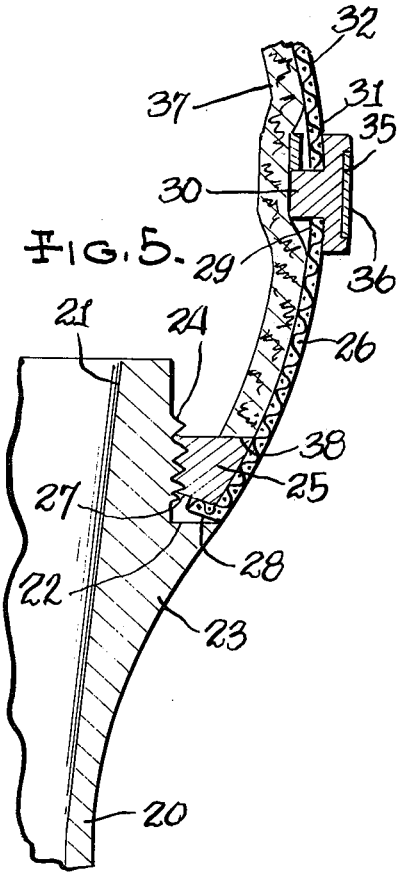
FIG. 5 is a fragmentary sectional view of parts shown in FIG. 4, and drawn to a further enlarged scale.

Attention is first directed to the prior art assembly shown in FIG. 1, wherein a support ring 10 is rigidly secured to the upper portion of the microphone body or handle 11, usually by soldering or cementing. The ball screen comprises an upper half 12 and a lower half 14, connected together by a coupler ring 15. The ring is of modified Z-shape in cross-section, having an upper annular channel to receive the lower peripheral margin of the upper screen, and a peripheral shoulder against which the upper peripheral margin of the lower screen is bonded. A base ring 16 is threaded onto the support ring 10 and is formed with an annular slot 17 in which the lower peripheral margin of the lower screen was soldered or cemented. This junction represented a weak point of the assembly.

In our improved construction, as seen in FIGS. 2 through 5, the upper end of the microphone body or handle 20 is formed with an upwardly projecting portion 21 forming a shoulder 22 with a gracefully curved wider portion 23 of the handle. The projecting portion 21 has external screw threads 24 cooperable with internal screw threads formed on a base ring 25.

The ring 25 has a curved exterior surface complementary to the internal curved surface of the lower screen 26, and an upwardly inclined lower surface 27 which closely receives an inwardly turned and upwardly inclined peripheral portion 28 which margins the lower opening in the lower screen 26. The portion 28 is bonded to the surface 27 in any suitable manner, such as by the use of an epoxy cement.

The peripheral margin 29 at the upper end of the lower screen 26 is seated against one leg of a coupler ring 30 which, in our improved construction is T-shaped in cross-section. The peripheral margin 31 at the lower end of the upper screen 32 is seated against the other leg of the coupler ring 30. The margins 29 and 31 are bonded to the coupler ring legs, also preferably by the use of an epoxy cement, so that the screens 26 and 30, the coupler ring 30 and the base ring 25 are a unitary assembly and may be assembled with or disassembled from the projecting portion 21 of the handle 20 as a unit.

The coupler ring 30 has a shallow annular recess 35 in which a band 36 may be held, the band carrying any desired indicia or ornamentation. It is preferred to form the coupling ring of a T cross-section since it is less expensive to manufacture and easier to assemble with the top and bottom screens.

As in the case of the prior art shown in FIG. 1, the assembly is completed by a foam screen 37 which is contoured to fit within the top and bottom screens. The peripheral margin 38 at the opening into the foam screen is cemented to the upper surface of the base ring 25. The microphone transducer is shown in dot-dash lines in FIGS. 1 and 4 since it forms no part of our invention.

We claim:

1. A microphone assembly, comprising:

a microphone body, having an externally threaded projection at an end thereof, said projection being of a smaller peripheral size than an adjoining portion of said body to provide a shoulder thereat, a screen having a portion surrounding said projection, a base ring having internal screw threads engaging the threads on said projection, and adapted to be threaded to functional position adjacent to said shoulder, said screen having an opening, the defining peripheral portion of which is secured to said base ring.

2. The construction according to claim 1 wherein said screen peripheral portion closely surrounds said base ring and conceals it from sight.

3. The construction according to claim 2 wherein said screen peripheral portion is bonded to said base ring to join the two as a unitary assembly.

4. The construction according to claim 2 wherein said screen peripheral portion is turned inwardly and underlies and is secured to the under surface of said base ring.

5. The construction according to claim 4 wherein said projection forms an annular shoulder with the adjoining portion of said body, said inturned peripheral portion being disposed between said under surface of said base ring and said shoulder.

6. The construction according to claim 5 wherein said inturned peripheral portion is claimed between said under surface of said base ring and said shoulder.

7. The construction according to claim 1 wherein said screen is of the ball type and is formed in two complementary sections, and a coupler ring between said sections and connected thereto.

8. The construction according to claim 7 wherein said coupler ring is T-shaped in cross-section, adjoining peripheral portions of said screen sections being secured to respective legs of said T.

9. The construction according to claim 8 wherein said adjoining peripheral portions of said screen sections are bonded to respective legs of said T to join said screen sections and said coupler ring as a unitary assembly.

10. The construction according to claim 1 wherein said adjoining portion of said body is circular in cross-section and said screen peripheral portion is substantially the same diameter as said adjoining portion.

* * * * *